United States Patent [19]

Albertson et al.

[11] Patent Number: 4,963,075

[45] Date of Patent: Oct. 16, 1990

[54] RADIAL DIAPHRAGM PUMP

[75] Inventors: Philip E. Albertson; Arthur D. Deken, both of Perry, Okla.

[73] Assignee: The Charles Machine Works, Inc., Perry, Okla.

[21] Appl. No.: 228,118

[22] Filed: Aug. 4, 1988

[51] Int. Cl.[5] ..... F04B 43/06; F04B 1/06

[52] U.S. Cl. ..... 417/273; 417/221

[58] Field of Search ..... 417/273, 221

[56] References Cited

U.S. PATENT DOCUMENTS

| | | | |
|---|---|---|---|
| 973,739 | 10/1910 | Alvergnat | 417/273 |
| 1,627,257 | 5/1927 | Stevens . | |
| 1,764,712 | 6/1930 | Brackeff et al. | 417/439 |
| 1,982,958 | 12/1934 | Kraus | 417/221 |
| 2,146,123 | 2/1939 | Logan . | |
| 2,255,852 | 9/1941 | Ludin . | |
| 2,364,111 | 12/1944 | Tucker . | |
| 2,545,315 | 3/1951 | Sproull | 91/497 |
| 2,568,357 | 9/1951 | Moulden | 417/221 |
| 2,703,055 | 3/1955 | Veth et al. . | |
| 3,174,436 | 3/1965 | Wanner . | |
| 4,236,874 | 12/1980 | Sisk | 417/315 |
| 4,358,252 | 11/1982 | Hart . | |

FOREIGN PATENT DOCUMENTS

| | | | |
|---|---|---|---|
| 1064811 | 9/1957 | Fed. Rep. of Germany | 417/273 |
| 2258696 | 11/1972 | Fed. Rep. of Germany | 417/273 |
| 857594 | 9/1940 | France | 417/221 |
| 132469 | 9/1919 | United Kingdom | 417/273 |
| 1403528 | 8/1975 | United Kingdom . | |

*Primary Examiner*—Leonard E. Smith

*Attorney, Agent, or Firm*—Banner, Birch, McKie & Beckett

[57] ABSTRACT

A pump assembly having a pair of parallel annular hollow manifolds forming a pump frame with a series of pump units carried by the manifolds radially arranged relative to a central drive shaft which extends axially of the centers of the ring-like manifolds. The drive shaft has an eccentric which cooperates with a bearing hub to impart orbital movement to the hub when the shaft rotates. Each pump unit has a cylinder and piston with a piston rod connected to the piston being coupled to the bearing hub to reciprocate the piston within the cylinder. A diaphragm carried by the cylinder is spaced from the piston to define a chamber between the diaphragm and piston containing a quantity of driving liquid with the opposite side of the diaphragm forming a wall portion of a cavity for the fluid to be pumped, this cavity having inlet and outlet valves housed in a tubular valve body connected to the manifolds. The drive shaft may have a pair of eccentrics rotatably engaged with each other whereby upon rotation of the eccentrics relative to each other, as when the drive shaft is rotated in opposite direction, variation in the stroke of the pistons within the pump units can be achieved.

14 Claims, 7 Drawing Sheets

RADIAL DIAPHRAGM PUMP

BACKGROUND OF THE INVENTION

This invention relates generally to the pump art and, more particularly, to a combination piston-diaphragm pump wherein a series of pump units are arranged radially with respect to a central driving shaft for these pump units.

A number of pumps have been proposed in the prior art intended for use in pumping extremely heavy, slurry-type mixtures. For example, in the well drilling industry the requirements for pumping drilling mud at high pressures and volumes have led to the development of a variety of drilling mud pumps.

In large measure, efforts to develop a reasonably priced pump for pumping drilling mud at high pressures and volumes have been unsuccessful. For a moderately priced pump where the size of the pump has been kept small and the weight low, the output pressure capabilities from the pump have also characteristically been low for a reasonable pump output of 100 gallons per minute. In contrast where large size heavy drilling mud pumps have been made available on the market, the reasonable 100 gallons per minute pump volume output can be delivered with pressures of 200 pounds per square inch or more but, the wear resistance of these pumps has been found to be poor. With these pumps high annual maintenance costs preceded by a high initial purchase cost are to be expected.

It will be recognized that the pumping of gritty slurry type mixtures such as drilling mud exposes any form of pump being used to unusually high wear conditions. Thus, it becomes imperative for the pump designer or developer to minimize wherever possible exposure of moving parts within the pump to the drilling mud as it is pumped through the pump apparatus. Numerous efforts have been made in pump development to meet this requirement for handling drilling mud. However, these prior art attempts have been less than successful in the past.

Of course, there are numerous other considerations which must be taken into account in the development of a reasonably priced drilling mud pump. Ideally, the weight and size of the pump need be kept in mind while still aiming to obtain the needed high pressures and high volumes for the drilling mud flow. Pump mounting flexibility must be kept in mind. A critical point for consideration must be ease of access for valve maintenance since valves controlling the flow of the abrasive drilling mud through the pump are inherently exposed to the most severe conditions by reason of the drilling mud flow. Ideally, providing for a wide range of pumping pressures and volumes for a given size of pump drive motor or engine is an important objective.

SUMMARY OF THE INVENTION

A principal object of the present invention is to provide a pump particularly adapted for pumping drilling mud at high pressures and volumes with minimum exposure of the moving pump parts to drilling mud flow and which can be manufactured at a reasonable price.

A further primary object of the instant invention is to provide a reasonably priced pump for pumping drilling mud having minimum weight, reduced discharge pulsations of the outflow of drilling mud, increased pump mounting and pump output flexibility and increased valve maintenance accessibility.

A further object is to provide a pump wherein the pump frame is provided by a pair of parallel ring-like hollow manifolds forming inlet and outlet headers with a series of pump units carried by the manifolds radially arranged relative to a central drive shaft thereby enabling achievement of the advantages of the above objects.

Another important object of this invention is the utilization of a series of combination piston-diaphragm pump units wherein separation of the piston and cylinder from abrasive fluids, such as drilling mud, is achieved by a quantity of hydraulic liquid captive between the piston and a wear resistant diaphragm, the opposite side of the diaphragm forming a wall portion of the cavity for the fluid to be pumped.

The pump invention herein achieves the above mentioned objects, aims and purposes by the pump having a pair of parallel ring-like hollow manifolds forming a pump frame with a series of pump units carried by the manifolds radially arranged relative to a central drive shaft which extends axially of the centers of the ring-like manifolds. The drive shaft carries an eccentric portion which cooperates with a bearing hub to oscillate the hub when this shaft rotates. Each pump unit has a cylinder and piston with a piston rod connected to the piston being coupled to the bearing hub to reciprocate the piston within the cylinder. A diaphragm carried by the cylinder is spaced from the piston to define a chamber between the diaphragm and piston, this chamber containing a quantity of driving liquid with the opposite side of the diaphragm forming a wall portion of a cavity for the fluid to be pumped, this cavity having inlet and outlet valves housed in duct means leading to the manifolds, respectively.

The central drive shaft may be provided with two eccentrics which are rotatably interengaged. With this pair of eccentrics, relative rotation between the eccentrics enables increasing or decreasing the magnitude of eccentricity relative to the rotational axis of the drive shaft. Thus, oscillations of the bearing hub about the exterior of the pair of eccentrics will inherently be varied and, in turn, the stroke of the pistons within the pump units will be changed. Reducing the eccentricity by rotating the pair of eccentrics relative to each other imparts a minimum stroke to the pistons of the pump units thereby reducing the pump volume output but enabling higher pump pressure output. In contrast, increasing the eccentricity of the pair of eccentrics by their rotation relative to each other, the stroke of the pistons within the pump units will be increased thereby increasing the pump output volume but reducing the magnitude of the pump output pressure capability for a given rotational energy input.

BRIEF DESCRIPTION OF THE DRAWINGS

The foregoing objects, as well as others, will become apparent through consideration of the following detailed description of the invention given in connection with the accompanying illustrations on the drawings in which.

DETAILED DESCRIPTION OF A PREFERRED EMBODIMENT

Figure 1:
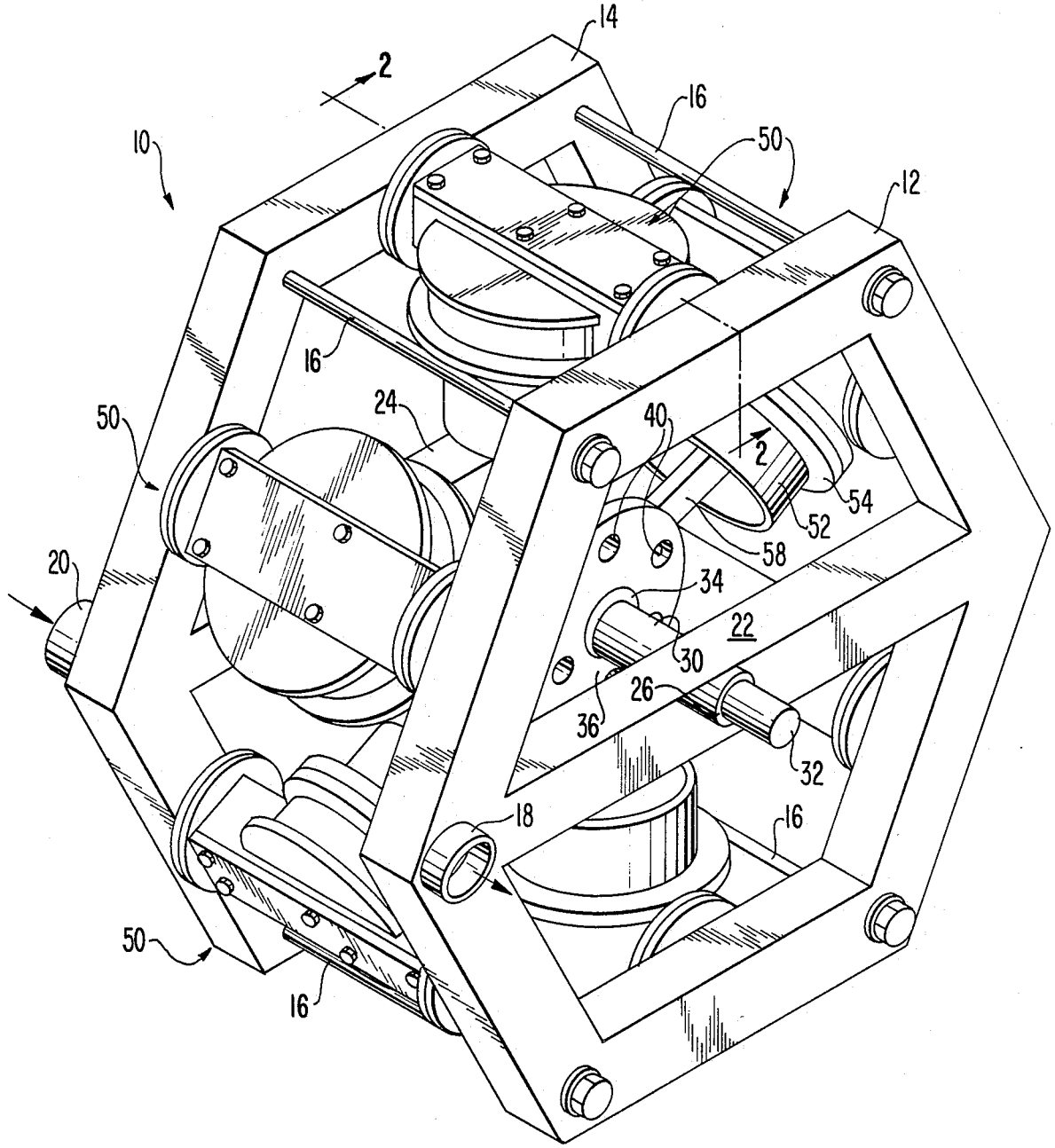
FIG. 1 is a perspective view of the combination piston-diaphragm pump of this invention.

FIG. 1 shows a perspective view of the combination piston-diaphragm pump 10. The pump frame is provided by a pair of annular, ring-like hollow manifolds 12 and 14 that form outlet and inlet headers respectively. Whereas these ring-like manifolds in the specifically illustrated embodiment are hexagonal it will be recognized that they can be octagonal, rectangular, or circular with an annular configuration. The hexagonal configuration for the ring-like hollow manifolds 12 and 14 lends itself to ease of construction of the manifolds themselves and also ideally adapts the ring-like manifolds to accommodating six individual pump units as will be described. However, a larger or smaller number of pump units may be used with the ring-like hollow manifolds, thereby allowing pumping volume changes merely by utilizing different numbers of pump units in the same pump frame.

Ring-like hollow manifolds 12 and 14 are connected together for example by suitable tie bolts 16. As shown, the tie bolts 16 serve to pull the ring-like manifolds 12 and 14 together, connecting them in spaced parallel relation to form the pump frame. The act of drawing the pair of manifolds 12 and 14 together serves to snugly clamp the several pump units between the manifolds as will be explained, giving a compact and sturdy overall construction.

Manifold 12 is provided with a fitting 18 and manifold 14 is provided with a similar fitting 20. These fittings lead into the interiors of the respective hollow manifolds 12 and 14. They may be internally threaded (not shown) or otherwise adapted to accommodate the inlet and outlet piping or hoses that are utilized to couple the piston-diaphragm pump into a system for the fluid to be pumped. As illustrated in FIG. 1, fitting 20 forms the inlet into manifold 14 while fitting 18 forms the outlet for the pumped fluid exiting from manifold 12.

Each of the manifolds 12 and 14 has a strengthening cross-member 22, 24 extending across the center of the ring-like manifold. Cross-member 22 extends across the center of manifold 12 and cross-member 24 extends across the center of manifold 14. In turn, each of cross-members 22 and 24 on manifolds 12 and 14, respectively, is provided with a bearing mounted at the center of the cross-member which corresponds with the center of the ring-like manifold. Bearing 26 appears on FIG. 1 at the center of cross-member 22 of manifold 12. The opposed center bearing for cross-member 24 of manifold 14 is not visible in the perspective view of FIG. 1.

A central drive shaft 30 is shown on FIG. 1 mounted in the center bearings of the cross-members 22 and 24 of manifolds 12 and 14, respectively. Shaft end 32 of drive shaft 30 projects outwardly beyond bearing 26 in cross-member 22. This shaft end 32 provides the means for rotational driving input to the piston-diaphragm pump 10. The shaft end 32 may be provided with a keyway so that any suitable motive power may be connected to shaft end 32 as by way of a belt and pulley drive or direct coupling of the power source to shaft end 32. Obviously, the driving power input may be supplied by an electric motor, internal combustion engine, or any other suitable rotational drive input.

Referring to FIG. 1, the energy input to central drive shaft 30 through its shaft end 32 is utilized by providing shaft 30 with an eccentric portion 34. A bearing hub 36 is fixed to eccentric portion 34, whereby an orbital motion is imparted to the bearing hub 36 upon rotation of the eccentric portion 34.

The driving action imparted from shaft 30 through eccentric portion 34 to bearing hub 36 may be enhanced by making the eccentric portion 34 of an eccentric sleeve 134 (FIG. 4) interpositioned between an eccentric segment 128 on shaft 30 and bearing hub 36. As shown, the intermediate eccentric sleeve 134 rotatably surrounds the eccentric segment 128 and is usable in conjunction with segment 128 to vary the stroke of the pistons of the pump units depending upon the relative orientation between the eccentric sleeve 134 and the eccentric segment 128, as will be explained hereinafter in more detail. It may be seen from FIG. 4 that bearing hub 36 has a cylindrical bore 38. In a preferred form of the invention, this bore 38 rotatably receives the eccentric segment 128 on central drive shaft 30 through the interpositioned eccentric sleeve 134. Alternatively, when a single eccentric portion 34 on shaft 30 is preferred, eccentric portion 34 is received directly within the bore 38 of the bearing hub 36.

Figure 4A:
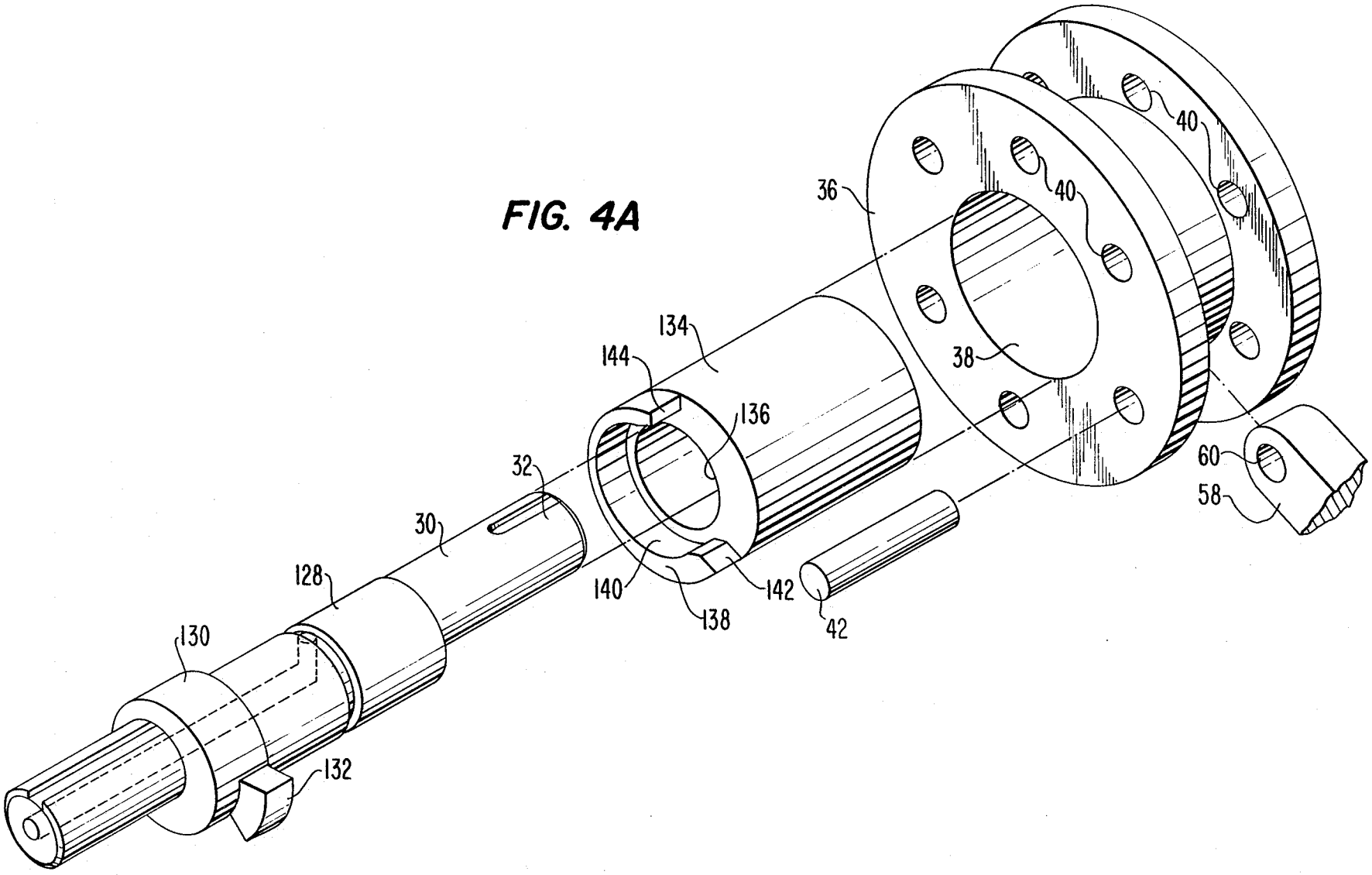
FIG. 4A is an exploded view of the central drive shaft and bearing hub oscillated by the drive shaft eccentric portion.
Figure 4B:
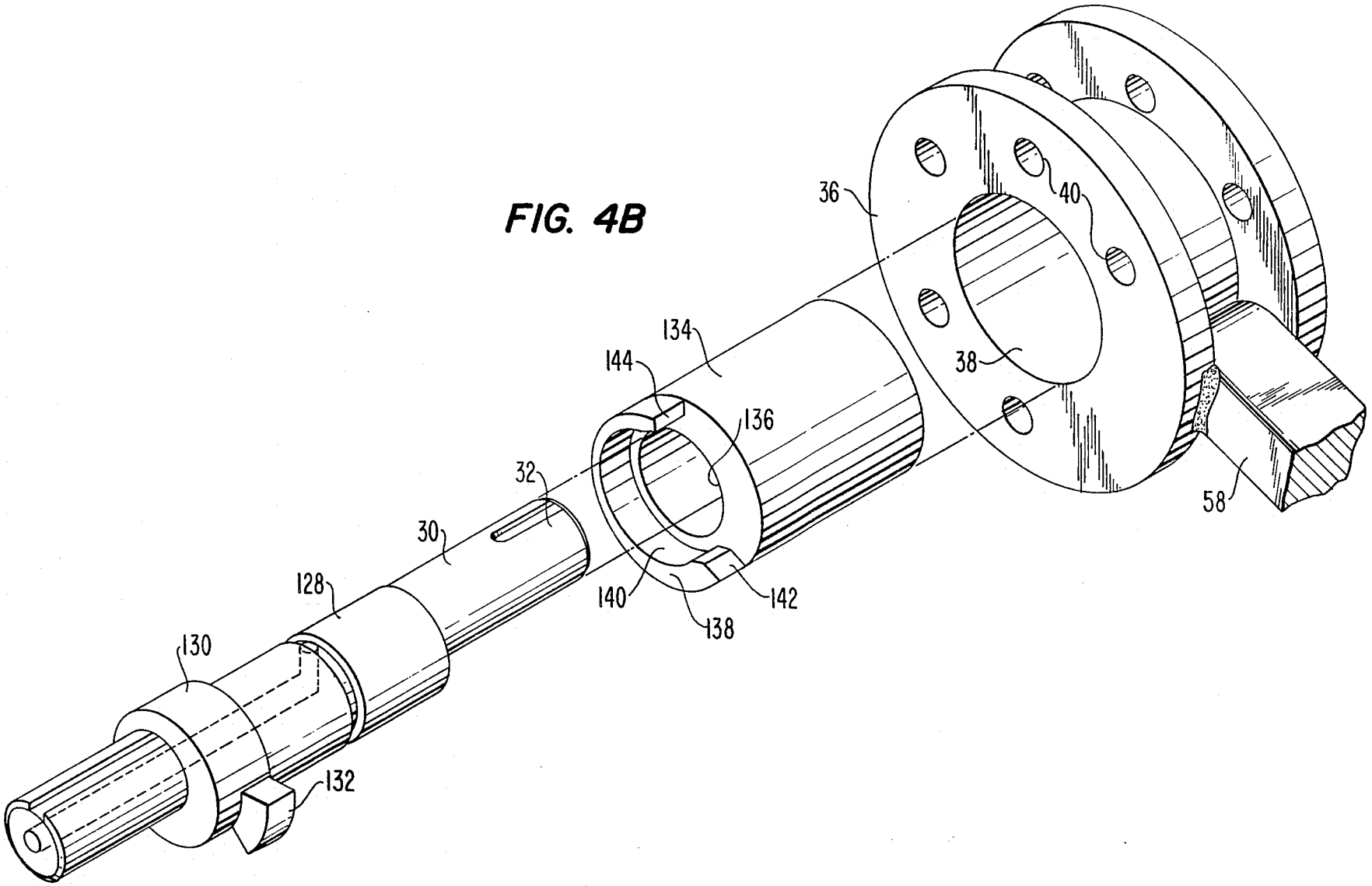
FIG. 4B is a view identical to FIG. 4A showing a preferred arrangement of the inventions whereby one of the piston rods is fixed to the hub.

Bearing hub 36 is in the form of a spool having a pair of annular flanges (FIG. 4) with a series of bores 40 circularly spaced around each of the flanges. Pairs of these bores 40 in the bearing hub flanges are aligned to accommodate a retaining pin 42 for connecting the piston rod 58 from each pump unit 50 to the bearing hub 36. One of the piston rods, however, preferably is fixed as by welding to the flanges of the hub 36, as shown in FIG. 4B. This fixed piston rod serves to prevent rotation of the bearing hub during operation of the piston-diaphragm pump 10.

Referring again to FIG. 1 and the perspective view of the piston-diaphragm pump 10 shown thereon, a number of the pump units 50 are arranged radially on the manifolds 12 and 14 relative to the central drive shaft 30. One of the pump units 50 is shown in section on FIG. 2 as it is mounted on the ring-like hollow manifolds 12 and 14. An exploded view of one of the pump units 50 mounted on manifolds 12 and 14 is shown on FIG. 3.

Figure 2:
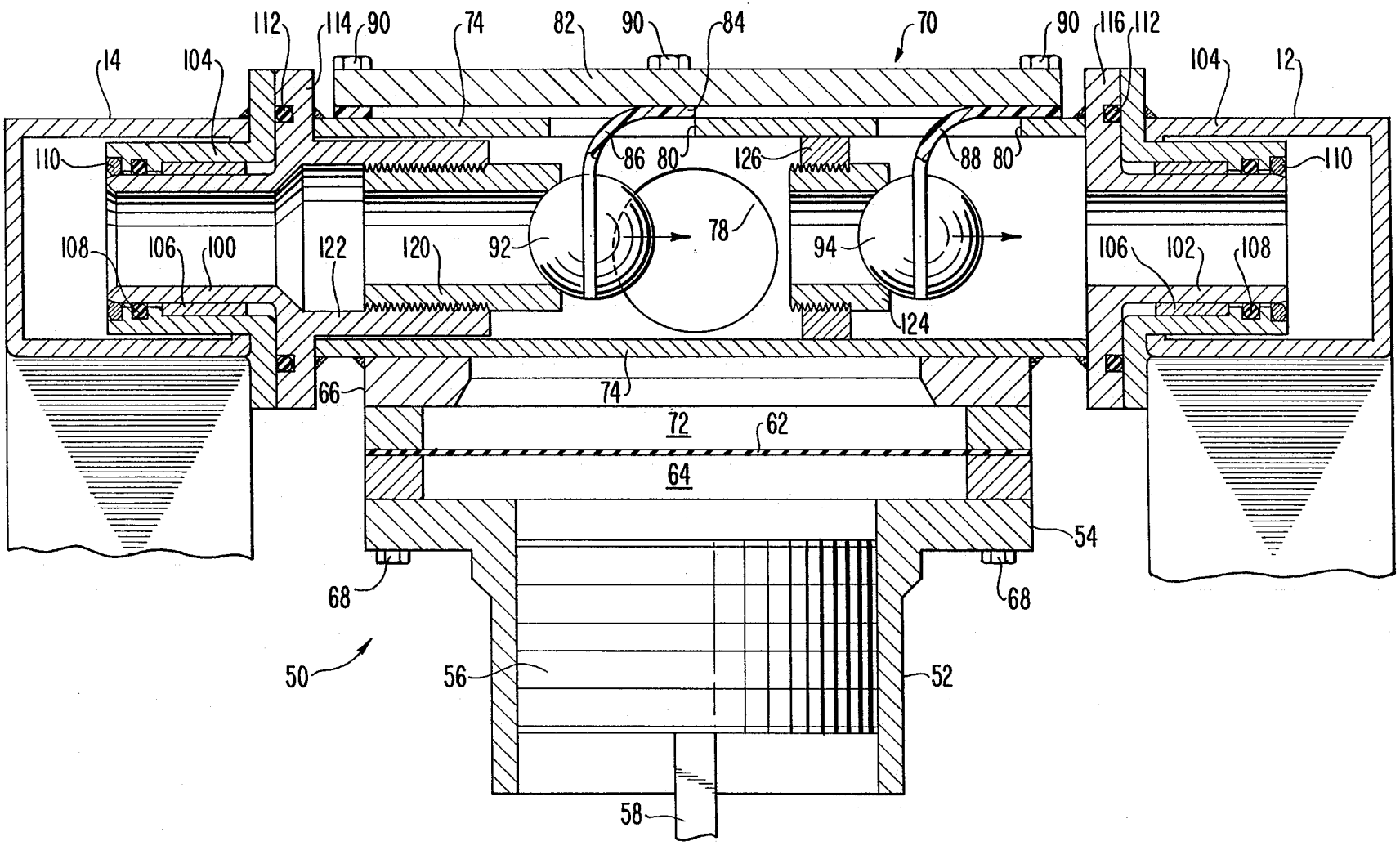
FIG. 2 is sectional view of one pump unit taken on line 2—2 of FIG. 1.

Referring to FIG. 2, each pump unit 50 has a cylinder 52 having an open end terminating in a flange 54. A piston 56 is reciprocally mounted in the bore of cylinder 52. A piston rod 58 is pivotally connected to piston 56 in a conventional manner for piston and piston rod interconnection. Piston rod 58 extends radially inwardly to have its end opposite the piston 56 coupled to the bearing hub 36 (FIG. 4). This opposite end of piston rod 58 has a bore 60 and is introduced between the flanges of the bearing hub 36 with bore 60 disposed in alignment with a pair of the aligned bores 40 formed in the flanges of bearing hub 36. Then pin 42 is pressed through the aligned bores 40 on bearing hub 36 and bore 60 on the end of piston rod 58. Pin 42 is appropriately fixed in this position relative to bearing hub 36 and piston rod 58 such that the piston rod is free to swing relative to bearing hub 36 under the effect of the hub oscillations created by eccentric 34 on central drive shaft 30.

All of the piston rods are pin connected to the bearing hub 36 in the manner hereinabove described except that, as noted above, one of the piston rods 58 is fixed to hub 36 as by being welded to the flanges of hub 36 to prevent hub rotation, as shown in FIG. 4B. On the other hand, all of the other piston rods 58 from the other pump units by being pin connected to the hub 36 are free to swing relative to the hub under the oscillating movements of the hub created by eccentric portion 34 on shaft 30.

A diaphragm 62 is mounted on cylinder 52 extending across the open end of cylinder 52 and spaced from the piston 56. This relationship of diaphragm 62 relative to cylinder 52 and piston 56 defines a chamber 64 between the diaphragm and piston. This chamber 64 is filled with a quantity of driving liquid such as a suitable hydraulic oil. By reason of the captive hydraulic oil in chamber 64, reciprocating movements of piston 56 within cylinder 52 transmit pulsating displacement movements to the diaphragm 62 corresponding to the direction of reciprocation which piston 56 is undergoing. It is to be noted that diaphragm 62 is larger in diameter than the diameter of piston 56. This allows the use of a thicker and more abrasion resistant diaphragm material, since required dispacement is reduced. Thus, a more abrasion resistant diaphragm material can be employed since the required displacement of diaphragm 62 relative to the reciprocating movements of piston 56 is substantially less than the piston reciprocating distance.

Preferably, the diaphragm 62 is made of a wear resistant polyurethane.

The diaphragm 62 is suitably mounted on cylinder 52 by being clamped between the flange 54 of cylinder 52 and a head ring 66. This clamping action retaining circular diaphragm 62 in place on cylinder 52 may be suitably effected by a series of cap screws 68 passing through circularly arranged holes in flange 54 with the cap screws 68 threaded into tapped holes circularly arranged in head ring 66.

A hollow valve body 70 is fixedly secured above diaphragm 62 as by being welded transversely across the head ring 66. Thus, the side of diaphragm 62 opposite the side facing chamber 64 forms a wall portion of a cavity 72, this cavity functioning to receive the fluid to be pumped, such as drilling mud. The hollow valve body 70 forms duct means which houses inlet valve means and outlet valve means as will be described.

The hollow valve body 70 is made up of a rectangular tube 74 which extends transversely of the diaphragm 62. Semi-circular housings 76 extend upwardly from the inner perimeter of head ring 66 to enclose the side walls of rectangular tube 74 as shown on FIG. 3. These side walls of tube 74 are formed with central apertures 78 so that the interior of rectangular tube 74 freely communicates with the pumped fluid cavity 72.

A pair of access openings 80 are disposed along one side wall of rectangular tube 74, these providing access to the inlet and outlet valve means housed within the tube 74 of hollow valve body 70. A cover plate 82 is provided to close access openings 80 and a gasket 84, in the form of a flexible plastic sheet, is disposed between the one side of tube 74 and cover plate 82.

Figure 3:
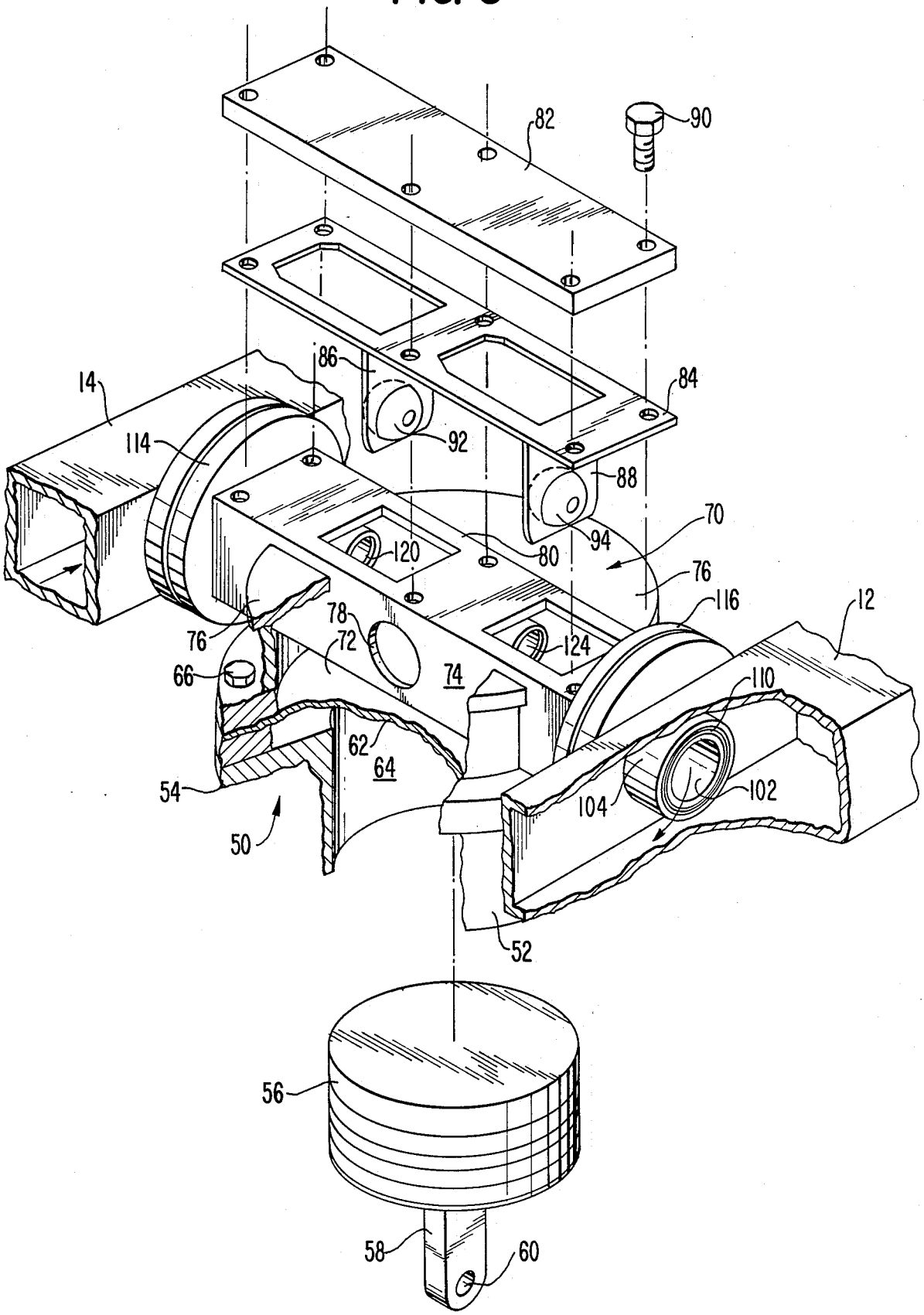
FIG. 3 is an exploded view, partially in section, of the pump unit components and the manifolds on which the pump units are carried.

Gasket 84 includes a pair of inwardly projecting flaps 86 and 88. Flaps 86 and 88 serve to support the inlet and outlet valve members, respectively. Cover plate 82 may be suitably secured to close access openings 80 by means of cap screws 90 passing through apertures in the cover plate 82 and gasket 84 to be threaded into tapped holes in the side wall of rectangular tube 74, as shown in FIG. 3.

As will be seen on FIG. 2, an inlet valve member 92 is carried by flexible plastic flap 86. In the specific example illustrated in FIG. 2, valve member 92 is a centrally split ball with the flap 86 extending between the two ball halves, these halves being bolted together with the flap 86 securely clamped between the two halves. Similarly, the outlet valve member 94 carried by flexible sheet plastic flap 88 is in the form of a split ball, with flap 88 disposed between the halves, and then the two halves bolted together with flap 88 securely clamped between the ball halves.

As an alternative to the above described split ball mounting for the inlet valve member 92 and outlet valve member 94, solid balls may be used for the inlet member 92 and outlet ball member 94. In this alternative, the end portions of flaps 86 and 88 are each formed into a semi-spherical configuration such that the ball valve members 92 and 94 may be seated in these semi-spherical configurations. With this approach, an entire exposed ball surface is exposed to the valve seat for anticipated longer wear life. The valve balls are not being fastened to the semi-spherical configuration but simply are pressed against the valve seat by the spring action of the bent down flaps 86 and 88.

Gasket 84 is preferably a flexible plastic sheet of urethane, approximately 0.10 inch thick. Thus, the single plastic sheet of urethane serves the combination of providing the gasket for the cover plate 82, acts as the valve member spring and supports the valve members relative to the valve seats.

The hollow valve body 70 which houses the inlet and outlet valve means has tubular journals 100 and 102 disposed to extend axially outwardly from the opposite ends of the rectangular tube 74, respectively. Tubular journal 100 of each pump unit 50 extends into interior of the intake manifold 14. Similarly, tubular journal 102 extends into the interior of outlet manifold 12.

The inlet and outlet ring-like hollow manifolds 12 and 14 are each provided with a series of support bearings 104. These support bearings are mounted in openings formed in the opposed faces of the spaced parallel manifolds 12 and 14. It will be understood that the number of support bearings 104 on each manifold will be equal to the number of pump units 50 which are to be supported between manifolds 12 and 14.

Support bearings 104 include a cylindrical sleeve bearing 106 mounted on the interior of the support member for bearing 104 and an O-ring 108 forming a seal on the side of sleeve bearing 106 facing toward the manifold 12 or 14. To minimize wear of O-ring 108, a rod wiper 110 is provided at the end of each support bearing 104 within the manifold 12 or 14, this rod wiper being external in each bearing support 104 to sleeve bearing 106 and O-ring 108.

A second O-ring 112 is disposed on the opposite side of sleeve bearing 106 from O-ring 108, this O-ring 112 being carried in an annular groove in the flange 114 of tubular journal 100 and flange 116 of tubular journal 102. Each of the O-rings 112 faces a radially projecting flange on the adjoining support bearing 104. An annular 0.062 inch layer of urethane may be interposed between the face of flange 114 and the face of the radially projecting flange on the adjoining support bearing 104. Likewise an annular urethane layer may be interposed between flange 116 and the flange of its adjoining support bearing 104.

A seat 120 for the inlet valve member 92 is carried by tubular journal 100. Seat 120 is threaded into an internally threaded portion 122 of the tubular journal. Thus, the valve member 92 supported and spring pressed by gasket flap 86 is maintained seated against seat 120 to keep the inlet valve means closed absent fluid flow through such inlet valve tending to open the valve.

The outlet valve 94 is supported on plastic flap 88 relative to a seat 124. This externally threaded seat 124 is threaded into a partition 126 fixedly secured transversely within the interior of rectangular tube 74. As in the case of the inlet valve member 92, the outlet valve member 94 is both supported on flap 88 and also spring pressed against valve seat 124 by the resiliency of the flexible flap 88.

Referring to the preferred embodiment shown in FIG. 4, an adjustable eccentric drive is shown. This adjustable eccentric configuration offers the benefit of providing a range of pumping pressures and volumes for a given rotational drive energy input. As shown in FIG. 4, central drive shaft 30 has an eccentric segment 128. It also has a larger cylindrical eccentric segment 130 having a degree of eccentricity relative to the axis of shaft 30 substantially equal to that of eccentric segment 128. The eccentric segment 130 carries an outwardly extending lug member 132.

An eccentric sleeve 134 is provided which has a cylindrical bore 136 of a diameter to mate with the cylindrical eccentric segment 128 on shaft 30. The exterior of eccentric sleeve 134 is of a diameter to mate with the interior bore 38 of bearing hub 36. Eccentric sleeve 134 also has a stop lug segment 138 extending axially from one end of sleeve 134. Segment 138 has an inner semicircular portion 140 which is of a diameter comparable to the diameter of the cylindrical eccentric segment 130.

Thus, when eccentric sleeve 134 is engaged over eccentric segment 128 and eccentric segment 130 on drive shaft 30, the bore 136 of sleeve 134 and semi-circular portion 140 of sleeve 134 surround eccentric segment 128 and eccentric segment 130, respectively. Likewise, the lug 132 engages within the cutout portion of the segment 138 on sleeve 134 which terminates in stop surfaces 142 and 144.

The extent of drive shaft eccentricity relative to the rotational axis of drive shaft 30 and thus the extent of oscillation of bearing hub 36 that is imparted to the piston rods 58 of the series of pumping units 50 can be easily varied. When sleeve 134 is rotated relative to shaft 30 so that the eccentricity of the sleeve 134 is added to the eccentricity of eccentric segment 128 on shaft 30, the maximum extent of oscillation will be imparted to bearing hub 36. Similarly, when sleeve 134 is rotated relative to shaft 30 such that the eccentricity of the sleeve is diminished by the eccentricity of eccentric segment 128 on shaft 30, the minimum extent of oscillating motion will be imparted to bearing hub 36.

The function of lug 132 cooperating with the stop surfaces 142 and 144, respectively, of semi-circular segment 138 operates as follows. Lug 132 may have an arcuate length of 45°. The cutout portion between the stop surfaces 142 and 144 of semi-circular segment 138 may have an arcuate length of 135°. With lug 132 disposed in the cutout portion of semi-circular segment 138, when lug 32 is engaged with stop surface 142 of segment 138, the eccentricities of sleeve 134 and segment 128 on shaft 30 are added such that a maximum eccentric throw and oscillation of bearing hub 36 will occur when shaft 30 is driven by motor power input to its end 32. If shaft 30 is driven by this motive power input in the opposite direction, the lug 132 will rotate out of contact with stop surface 142 of segment 138 while eccentric sleeve 134 tends to remain stationary and the opposite side of lug 132 will thereafter engage stop surface 144 of segment 138 on sleeve 134. In this relationship, the eccentricity of eccentric segment 128 on shaft 30 will essentially be subtracted from the eccentricity of sleeve 134. In this driving direction of shaft 30 the lowest extent of oscillating movement will be imparted to bearing hub 36. Consequently, the piston movements within the pump units will be lower and a lower volume but higher pressure of the pumped fluid can be achieved for a given rotational energy input.

The pumping operation for the piston-diaphragm pump described hereinabove should be clear from the above described structure. With rotational drive input from a suitable power source supplied to the end 32 of central drive shaft 30, the eccentricity of the shaft will impart oscillating motion to the bearing hub 36. This motion will in turn be imparted through the piston rods 58 to the pistons 56, reciprocating these pistons within the cylinders 52 of the series of pump units 50.

Reciprocation of pistons 56 transmits through the hydraulic liquid in chamber 64 pulsating displacement to the diaphragm 62. Diaphragm 62 also is exposed to the chamber 72 which contains the fluid to be pumped, such as drilling mud. As viewed in FIG. 2, when piston 56 withdraws from cylinder 52 the liquid in chamber 64 also displaces diaphragm 62 downwardly drawing in fluid to be pumped from inlet manifold 14, through tubular journal 100, valve seat 120 thereby opening valve member 92. At this state, the outlet valve 94 is held firmly against its seat 124 by the spring action of flap 88 as well as the suction supplied by the downward displacement of diaphragm 62.

Again referring to FIG. 2, upon upward movement of piston 56 in cylinder 52 the hydraulic liquid in chamber 64 will displace diaphragm 62 upwardly allowing inlet valve 92 to seat on its seat 120 both by the spring action of flap 86 and by the pressure created by the upward displacement of diaphragm 62. The fluid to be pumped in chamber 72 will then be expelled through seat 124 displacing outlet valve 94 against the spring action of flap 88 thereby allowing the fluid to be pumped out through tubular journal 102 and into outlet manifold 12.

Obviously, each of the pump units 50 will undergo the above operating actions as the pistons 56 are reciprocated under the oscillating movements imparted thereto through their piston rods 58 from oscillation of bearing hub 36 by the eccentricity on shaft 30.

Where the adjustable eccentric drive as described with reference to FIG. 4 is employed, the driving input imparted to the end 32 of central drive shaft 30 occurring in one rotational direction will impart the maximum reciprocating stroke to pistons 56. Where this rotational driving input occurs in the opposite direction, the eccentric sleeve 134 will orient itself relative to the eccentric segment 128 on shaft 30 such that a minimum oscillating movement will be imparted to bearing hub 36. Consequently, less reciprocating motion will be imparted to the pistons 56 and the diaphragm 62 in each pump unit 50 displaced a lesser amount.

There are several advantageous features of the combination piston-diaphragm pump of this invention as described hereinabove. The utilization of the parallel hollow ring-like manifolds to form the pump frame and also provide inlet and outlet headers serves to reduce pump weight, reduce discharge pulsations from the pump, increase pump mounting flexibility and increase accessibility for valve maintenance. Separation of the reciprocating piston and cylinder in each pump unit 50 from pumped abrasive fluids, such as drilling mud, by the hydraulic liquid and a wear resistant polyurethane diaphragm eliminates a major source of wear and maintenance.

The hollow valve body simplifies construction and minimizes interference with abrasive fluids while still providing ease of access to the valve assembly. Also, the construction is simplified by the one piece gasket and flaps which form the valve member spring and guide. Indeed, the valve and gasket assembly may be installed upside down to increase the service life of the assembly.

Arranging the pump units 50 radially around the central drive shaft 30 gives a configuration which maximizes the commonality of parts for economics in manufacture, it minimizes the required size of the center drive shaft and eccentric drive and reduces the number of bearings subjected to high loads and high velocity, thereby simplifying the support for those bearings.

The diaphragm is full floating between the hydraulic liquid in chamber 64 and the pumped fluid in cavity 72, minimizing stress and strain since the diaphragm 62 is not attached to the piston 56. The larger diameter of the diaphragm 62 as compared to the piston 56 greatly reduces the required displacement of the diaphragm thereby allowing the use of a thicker more abrasion resistant diaphragm material such as polyurethane.

The design flexibility of the piston-diaphragm pump is enhanced by the modular concept, allowing pumping volume changes by using a different number of pump units 50 in the same manifold frame or by stacking these manifold frames with common outlet and inlet manifold frames.

The adjustable eccentric drive described with reference to FIG. 4 further increases design flexibility. The limited rotation between the eccentric shaft segment and eccentric sleeve relative to each other offers a much wider range of pumping pressures and volumes for a given size of drive motor or engine.

While the lug 132 has been shown carried by eccentric 130 on shaft 30 whereas the lug stop is provided by the semi-circular segment 138 on eccentric sleeve 134, this arrangment could be reversed. The lug could be carried by the eccentric sleeve 134 projecting toward the shaft 30 centerline to engage stops formed on the end of the eccentric segment 130 of the shaft 30.

Figure 5:
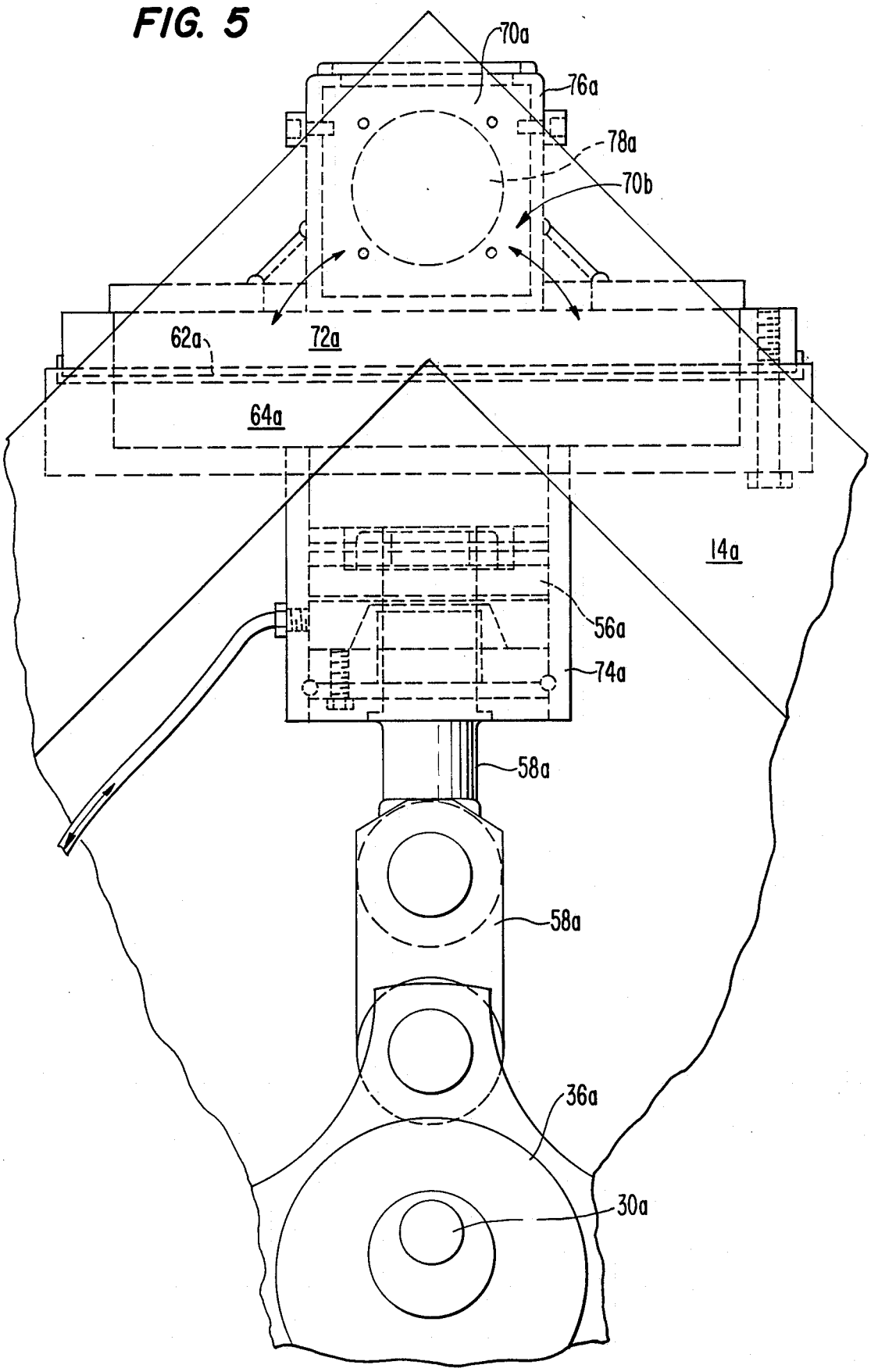
FIG. 5 is a fragmentary elevational view with parts broken away and in section of an alternative embodiment of the invention.
Figure 6:
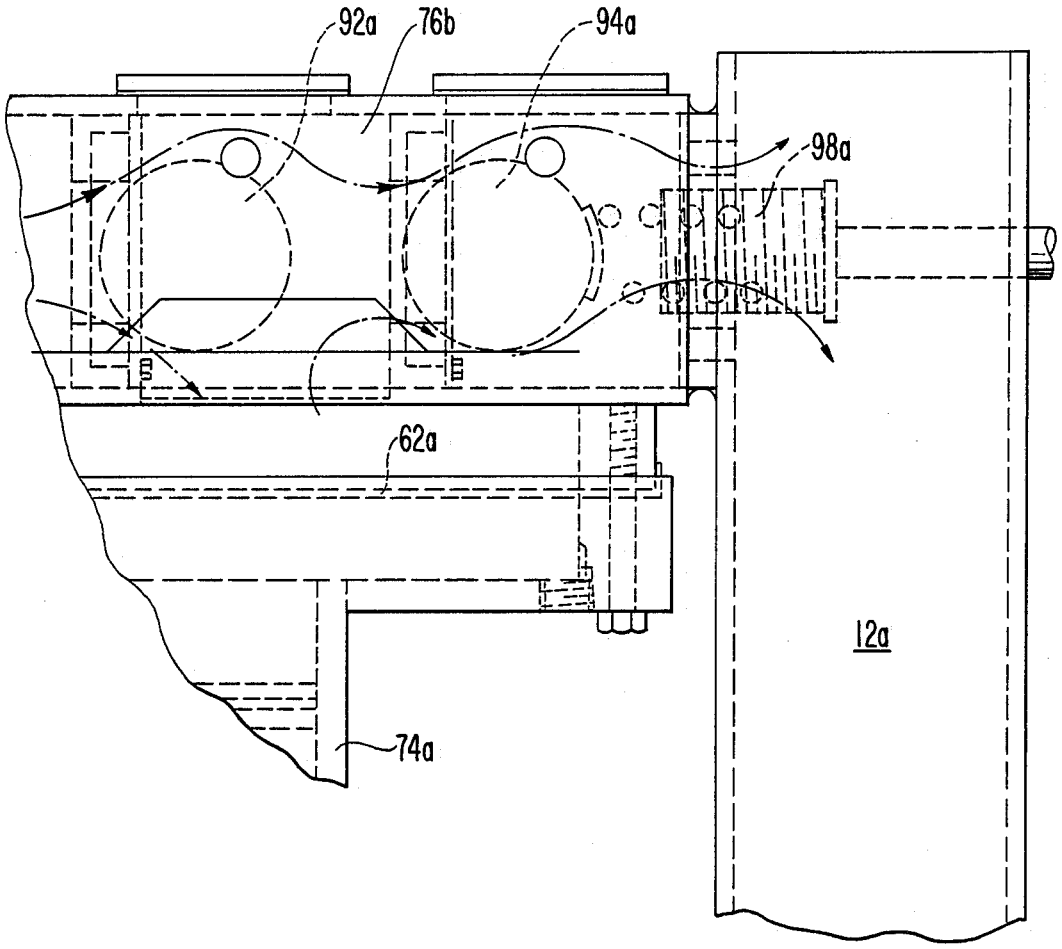
FIG. 6 is a fragmentary sectional view substantially on the line 6—6 of FIG. 5.

With reference to FIGS. 5 and 6 there is shown a modification of the invention in which the piston chambers 52 are fixed to the manifold 12 and 14 rather than journaled thereon by the tubular journals 100 and 102.

As shown in FIGS. 5 and 6, there is provided a pump frame comprising an intake manifold **14*a* and an outlet manifold 12*a*. A hollow valve body 70*a* is mounted between manifolds 12*a* and 14*a* and secured, as by welding at its ends, to the manifolds 12*a* and 14*a*. The ends of valve body 70*a* open into the manifolds. Preferrably, the valve body 70*a* is secured across the top of the housing 76*a*. An opening 76*b* in the top wall of the housing 76*a* communicates with openings 78*a* in the side walls of the valve body. A welded cover piece 70*b* provides a communication path between the openings 76*b* and 70*b*. Flow of the pumped fluid from the intake manifold 14*a* from the valve body 70*a* into the outlet manifold is controlled by the valve members 92*a* and 94*a* respectively. Valve members 92*a* and 94*a* are biased to the closed position by a coil spring such as the spring 98*a***.

A diaphragm **62*a* extends across the housing 76*a* to divide the same into a piston chamber 64*a* and pumped fluid chamber 72*a*. The chamber 72*a* in turn is open to the top of the piston cylinder 74*a* in which a piston 56*a* reciprocates—the space between the piston 56*a* and the diaphragm 62*a* being filled with a driving liquid. At its lower end, the piston 56*a* is connected to a piston rod 58*a* and is fixed for inward sliding relative to the piston cylinder 52*a*. Piston rod 58*a* is in turn pivotally connected to a link 58*b* that is also pivotally connected to a bearing hub 36*a* that is functionally similar to the bearing hub 36 and is mounted on the drive shaft 30*a* to an eccentric that may be substantially as shown in the embodiment of FIGS. 1 through 4. The bearing hub 36*a*** may be held against rotation by a torque arm (not shown) that is fixed at one end to the bearing hub and at the other end is received for endwise reciprocation and for limited pivotal movement on a bearing bracket mounted on the front frame.

Preferably piston chamber **64*a*** is filled with the piston at the bottom of its stroke so that back pressure of the diaphragm will prevent cavitation of hydraulic fluid during the suction stroke.

One of the advantages of fixing the valve bodies **70*a*** to the pump frame is that it avoids the necessity of sealing the pivotal connection between the valve bodies and the manifolds, thus not only simplifying the design but also eliminating a wear point and the potential source of leaks.

It is to be understood that the pump constructions of the embodiments of the invention herein shown and described must be taken only as preferred representations of the invention. Various changes and modification in the arrangement of the components, parts, units, elements, etc. may be resorted to without departing from the disclosure of the invention or the scope of the appended claims.

We claim:

1. A radial diaphragm pump assembly for pumping heavy, slurry-type mixtures, said pump assembly comprising:

a pair of annular hollow manifolds connected in spaced relation, said manifolds forming a pump assembly frame for supporting a plurality of pump units, one of said manifolds providing an inlet for the pump assembly, the other of said manifolds providing an outlet for the pump assembly;

a drive shaft rotatably mounted on said manifolds for providing rotational driving input to the pump assembly, said drive shaft extending axially through said annular manifolds, said drive shaft having an eccentric segment thereon;

an eccentric sleeve rotatably surrounding said eccentric segment, the relative position of said eccentric sleeve with respect to said eccentric segment on said drive shaft providing the drive shaft eccentricity, said eccentric sleeve rotatable with said drive shaft;

a bearing hub having an axial bore therethrough, said eccentric sleeve engaging said axial bore so that rotation of said drive shaft imparts orbital motion to said bearing hub;

adjustment means for adjusting the relative position of said eccentric sleeve with respect to said eccentric segment and thereby adjusting the drive shaft eccentricity and the resulting orbital motion of said bearing hub, said adjustment means providing maximum drive shaft eccentricity upon rotation of said drive shaft in one direction and minimum drive shaft eccentricity upon rotation of said drive shaft in the other direction;

a plurality of pump units operatively connected to said bearing hub and supported between said manifold, each of said pump units comprising a cylinder, a piston reciprocal within said cylinder, and a piston rod having one end connected to said piston and the other end connected to said bearing hub, said pump units having a pump unit inlet operatively connected to said inlet in one of said manifolds and a pump unit outlet operatively connected to said outlet in the other of said manifolds, said pump unit inlet and said pump unit outlet comprising an inlet and an outlet valve, respectively, and a tubular valve body, said inlet and outlet valves mounted in said tubular valve body, one end of said tubular valve body operatively connected to said inlet in one of said manifolds and the other end of said valve body operatively connected to said outlet in the other of said manifolds, said tubular body comprising a tubular journal at the opposite ends thereof, said manifolds having a series of support bearings mounted on opposed faces of said manifolds, said support bearings on each manifold being equal in number to said number of pump units, said tubular journal at said opposite ends of said valve body being engaged with said opposed support bearings on said opposed faces of said manifolds to support each of said pump units on and between said manifolds, whereby rotation of said drive shaft imparts orbital motion to said bearing hub through said eccentric segment and said eccentric sleeve thereby reciprocating said piston rods and said pistons so that said pump units pump fluid through the pump assembly and whereby the stroke of said pistons is varied depending on the drive shaft eccentricity determined by the relative position of said eccentric segment and said eccentric sleeve.

2. A pump assembly as recited in claim 1 wherein said tubular valve body has at least one access opening disposed along one side thereof for access to said inlet and outlet valves, a cover plate is secured to close said opening, and a flexible plastic sheet forms a gasket between said valve body and said cover plate, said flap of flexible sheet plastic being excised from said plastic sheet.

3. A radial diaphragm pump assembly for pumping heavy, slurry-type mixtures, said pump assembly comprising:

a pair of annular hollow manifolds connected in spaced relation, said manifolds forming a pump assembly frame for supporting a plurality of pump units, one of said manifolds providing an inlet for the pump assembly, the other of said manifolds providing an outlet for the pump assembly, said manifolds each having a strengthening cross member extending across the center of the annular manifold with a center bearing mounted at the center of said cross members;

a drive shaft rotatably mounted in the opposed center bearings of said annular manifolds, said drive shaft extending axially through said annular manifolds and providing rotational driving input to the pump assembly, said drive shaft having an eccentric segment thereon;

an eccentric sleeve rotatably surrounding said eccentric segment, the relative position of said eccentric sleeve with respect to said eccentric segment on said drive shaft providing the drive shaft eccentricity, said eccentric sleeve rotatable with said drive shaft;

a bearing hub having an axial bore therethrough, said eccentric sleeve engaging said axial bore so that rotation of said drive shaft imparts orbital motion to said bearing hub;

adjustment means for adjusting the relative position of said eccentric sleeve with respect to said eccentric segment and thereby adjusting the drive shaft eccentricity and the resulting orbital motion of said bearing hub, said adjustment means providing maximum drive shaft eccentricity upon rotation of said drive shaft in one direction and minimum drive shaft eccentricity upon rotation of said drive shaft in the other direction;

a plurality of pump units operatively connected to said bearing hub and supported between said manifolds, each of said pump units comprising a cylinder, a piston reciprocal within said cylinder, and a piston rod having one end connected to said piston and the other end connected to said bearing hub, said pump units having a pump unit inlet operatively connected to said inlet in one of said manifolds, and a pump unit outlet operatively connected to said outlet in the other of said manifolds, whereby rotation of said drive shaft imparts orbital motion to said bearing hub through said eccentric segment and said eccentric sleeve thereby reciprocating said piston rod and said piston so that said pump units pump fluid through the pump assembly and whereby the stroke of said piston is varied depending on the drive shaft eccentricity determined by the relative position of said eccentric segment and said eccentric sleeve.

4. A pump assembly as recited in claim 3 wherein said adjustment means comprises interengageable stop means disposed between said eccentric sleeve and said eccentric segment on said drive shaft for limiting relative rotation between said eccentric sleeve and said eccentric segment.

5. A pump assembly as recited in claim 4 wherein said interengageable stop means includes a lug member and a lug stop member, one of said members being carried by said shaft and the other of said members being carried by said eccentric sleeve.

6. A pump assembly as recited in claim 5 further comprising a second eccentric segment on said drive shaft, said second eccentric segment having an eccentricity substantially equal to the eccentricity of said first eccentric segment, and wherein said lug member is fixed to and extends radially outwardly from said second eccentric segment.

7. A pump assembly a recited in claim 6 wherein said lug stop member extends axially from one end of said eccentric sleeve, said lug stop member having a first stop surface and second stop surface whereby rotation of said drive shaft in one direction causes said lug member to engage said first stop surface of said lug stop member and rotation of said drive shaft in the other direction cause said lug member to engage said second stop surface.

8. A radial diaphragm pump assembly for pumping heavy slurry-type mixtures, said pump assembly comprising:

a pair of annular hollow manifolds connected in spaced relation, said manifolds each having a strengthening cross member extending across the center of the annular manifold with a center bearing mounted at the center of said cross members, said manifolds forming a pump assembly frame for supporting a plurality of radial diaphragm pump units, one of said manifolds providing an inlet for the pump assembly, the other of said manifolds providing an outlet for the pump assembly;

a drive shaft rotatably mounted in the opposed center bearings and extending axially through said annular manifolds, said drive shaft providing rotational driving input to the pump assembly;

variable eccentric means on said drive shaft for providing a variable drive shaft eccentricity, said variable eccentric means providing maximum drive shaft eccentricity upon rotation of said drive shaft in one direction and minimum drive shaft eccentricity upon rotation of said drive shaft in the other direction;

a bearing hub having an axial bore therethrough, said variable eccentric means engaging said axial bore so that rotation of said drive shaft imparts variable orbital motion to said bearing hub;

a plurality of pump units operatively connected to said bearing hub and supported between said manifold, said pump units radially projecting from said drive shaft, each of said pump units comprising a cylinder having an open end, a piston reciprocal within said cylinder, and a piston rod having one end connected to said piston and the other end connected to said bearing hub;

a diaphragm extending across said open end of each said cylinder and spaced from each said piston thereby defining a chamber between each said diaphragm and piston, each said chamber filled with the driving fluid whereby reciprocating movement of said pistons in said cylinders causes said diaphragms to pulsate;

said pump units having a pump unit inlet operatively connected to said inlet in one of said manifolds and a pump unit outlet operatively connected to said outlet in the other of said manifolds, whereby rotation of said drive shaft imparts orbital motion to said bearing hub through said variable eccentric means and the stroke of said pistons may be varied depending on the drive shaft eccentricity determined by said variable eccentric means.

9. A pump assembly as recited in claim 1 further comprising a valve body fixed to said cylinder above said diaphragm, said valve body having an inlet and an outlet, said valve body inlet operatively connected to said inlet in one of said manifolds and said valve body outlet operatively connected to said outlet in the other of said manifolds.

10. A pump assembly as recited in claim 8 wherein said variable eccentric means comprises an eccentric segment on said drive shaft and an eccentric sleeve rotatably surrounding said eccentric segment on said drive shaft, the relative position of said eccentric sleeve with respect to said eccentric segment determining the drive shaft eccentricity.

11. A pump assembly as recited in claim 10 further comprising interengagable stop means disposed between said eccentric sleeve and said eccentric segment on said drive shaft for limiting relative rotation between said eccentric sleeve and said eccentric segment.

12. A pump assembly as recited in claim 11 wherein said interengagable stop means includes a lug member and a lug stop member, one of said members being carried by said shaft and the other of said members being carried by said eccentric sleeve.

13. A pump assembly as recited in claim 12 further comprising a second eccentric segment on said drive shaft, said second eccentric segment having an eccentricity substantially equal to the eccentricity of said first eccentric segment, and wherein said lug member is fixed to and extends radially outwardly from said second eccentric segment.

14. A pump assembly as recited in claim 13 wherein said lug stop member extends axially from one end of said eccentric sleeve, said lug stop member having a first stop surface and second stop surface whereby rotation of said drive shaft in one direction causes said lug member to engage said first stop surface of said lug stop member and rotation of said drive shaft in the other direction causes said lug member to engage said second stop surface.

* * * * *